US005477866A

United States Patent [19]

Davenport

[11] Patent Number: 5,477,866

[45] Date of Patent: Dec. 26, 1995

[54] LEG SUPPORT PILLOW

[76] Inventor: Douglas Davenport, 3685 S. Highland Dr., #15, Las Vegas, Nev. 89103

[21] Appl. No.: 20,121

[22] Filed: Feb. 19, 1993

[51] Int. Cl.[6] ..... A47C 20/00

[52] U.S. Cl. ..... 128/845; 5/648; 5/652

[58] Field of Search ..... 128/845; 5/652, 5/648, 462, 650

[56] References Cited

U.S. PATENT DOCUMENTS

| | | | |
|---|---|---|---|
| 2,281,629 | 5/1942 | Snow | 128/845 X |
| 2,709,435 | 5/1955 | Kress | 5/648 X |
| 3,345,656 | 10/1967 | Steinman | 5/650 |
| 3,901,228 | 8/1975 | Brown | 128/845 |
| 3,931,654 | 1/1976 | Spann | 5/650 |
| 3,946,451 | 3/1976 | Spann | 5/650 |
| 4,071,031 | 1/1978 | Lowman | 5/648 X |
| 4,397,052 | 8/1983 | Lund, III | 5/462 |
| 5,134,739 | 8/1992 | Gaffe et al. | 5/648 |

FOREIGN PATENT DOCUMENTS

| | | | |
|---|---|---|---|
| 3045714 | 12/1982 | Germany | 5/648 |

*Primary Examiner*—Steven A. Bratlie
*Attorney, Agent, or Firm*—Price, Gess & Ubell

[57] ABSTRACT

A support pillow for the leg and foot comprising a substantially solid foam member, the foam member being of uniform cross-section and having a first support arm rising to a first height, a second support arm rising to a second height, and a support channel located therebetween. The height of the first support arm is selected to prevent sideward or rotational movement of the foot.

2 Claims, 2 Drawing Sheets

LEG SUPPORT PILLOW

BACKGROUND OF THE INVENTION

1. Field of the Invention

The subject invention relates to medical appliances and, more particularly, to a leg support pillow.

2. Description of Related Art

In prior art applications, conventional stuffed cloth pillows have been used in hospitals and various other context to support the leg. Such pillows find particular use in the treatment of multiple sclerosis and broken limbs. Use of such pillows is very expensive, particularly considering the disposability requirements and increasing use in hospitals and other medical treatment facilities.

Another disadvantage of such conventional pillows recognized by the inventor is that they provide no support against the tendency of the foot to rotate or turn sidewards. Such movement can impair or retard the healing process.

SUMMARY OF THE INVENTION

It is therefore an object of the invention to provide an improved leg support means;

It is another object of the invention to provide such a means which is relatively inexpensive, as well as disposable;

It is another object of the invention to provide a support pillow which features ease of patient entry and withdrawal, as well as ease of institutional use; and It is another object of the invention to provide a support pillow which prevents lateral or rotational foot movement and thereby aids and shortens the healing process.

According to the invention, a support pillow is fabricated of a semirigid foam material. The pillow has first and second support arms providing a support channel or trough between them. One of the support arms is of a height lower than the other and selected to permit ease of leg entry into the channel. The pillow is designed such that the channel is at an appropriate elevation to support the leg. The higher arm is of a height and angle which provides side support to and prevents rotational movement of the foot. The pillow is of a uniform cross-sectional dimension and readily fabricated in quantities, leading to a relatively inexpensive product.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DESCRIPTION OF THE PREFERRED EMBODIMENTS

Figure 1:
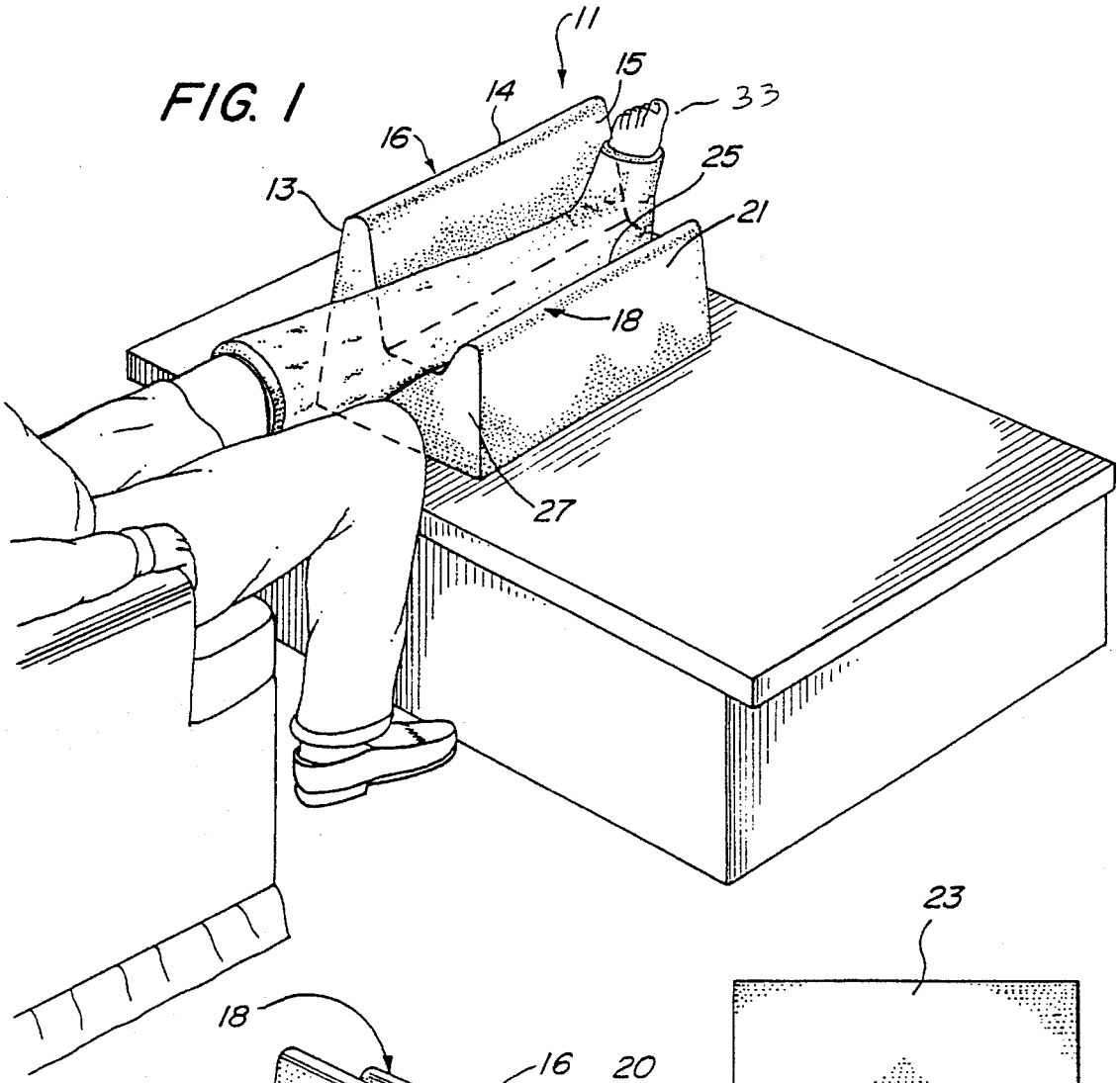
FIG. 1 shows a perspective view of a leg support pillow according to the preferred embodiment in use.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide an easily used and readily manufactured leg support pillow.

As shown in the figures, the leg support pillow 11 of the preferred embodiment includes first and second outer sides 13, 21, and first and second inner sides 15, 19. The first outer side 13 and first inner side 15 form a first support arm 16, while the second outer side 21 and second inner side 19 form a second support arm 18. A surface 17 extends between the first support arm 16 and the second support arm 18 to establish a leg support channel or trough 20.

Figure 3:
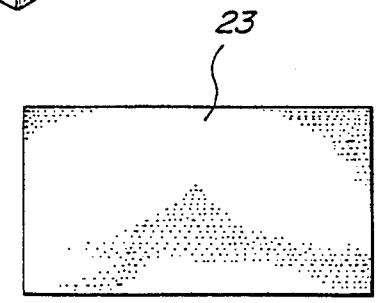
FIG. 3 is a view of the bottom surface of a leg support pillow of the preferred embodiment.
Figure 2:
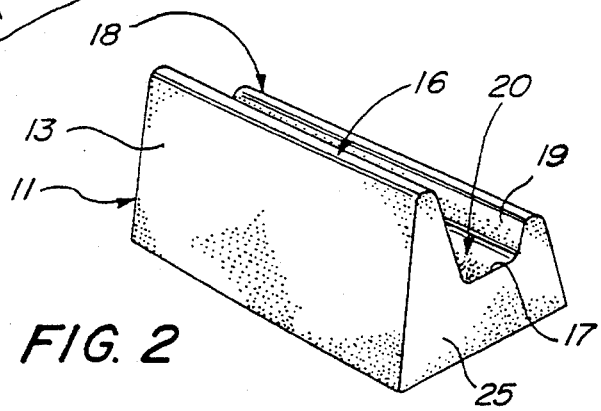
FIG. 2 shows a perspective view of a leg support pillow according to the preferred embodiment.

The support pillow 11 terminates at each end in end faces 25, 27. These end faces 25, 27 are of identical shape, and the support pillow itself has a uniform cross-section between these two end surfaces 25, 27. As shown in FIG. 3, the support pillow 11 has a rectangular base 23.

Figure 4:
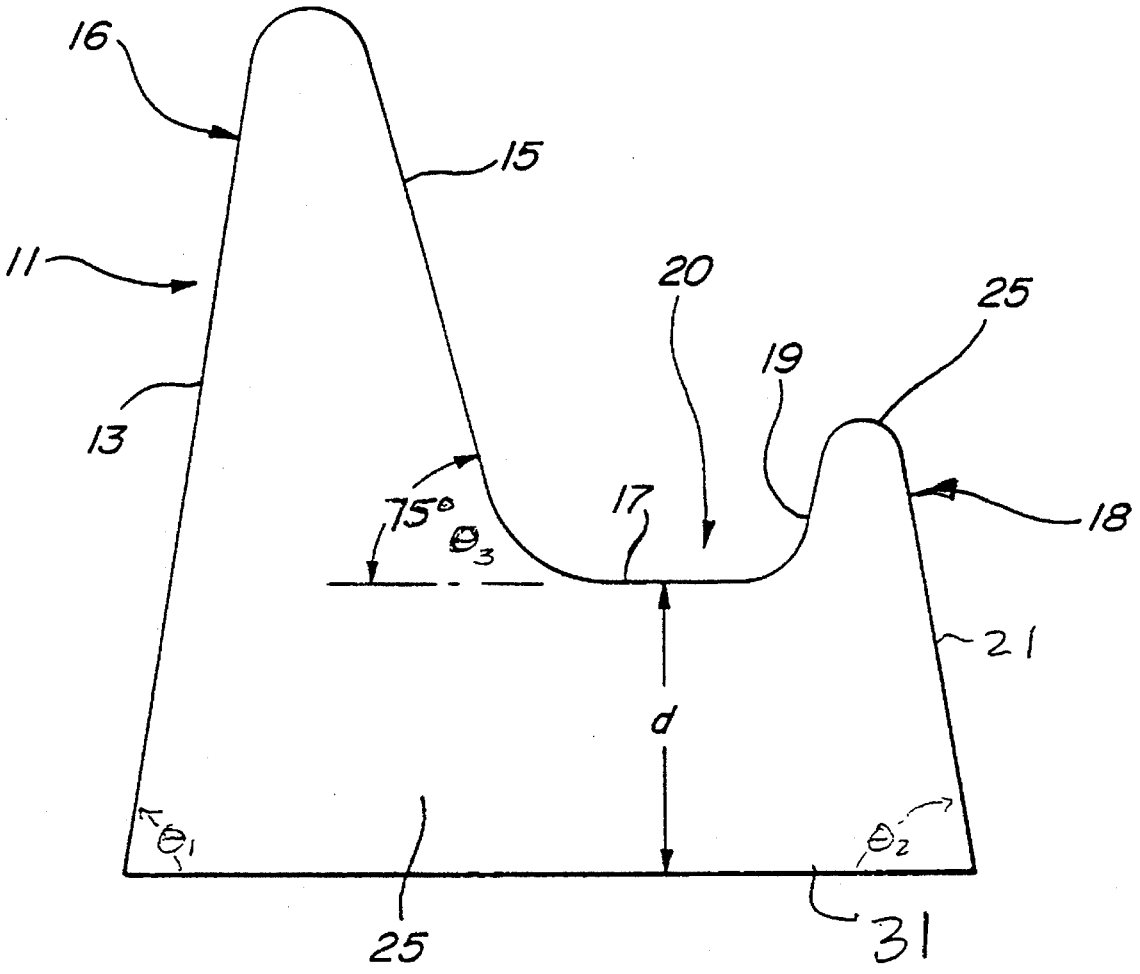
FIG. 4 is an elevational end view of the pillow according to the preferred embodiment.

In one configuration according to the preferred embodiment, the support arm 16 extends above the base 23 to a height of, for example, 12 inches. This is considerably higher than the height selected for the distance between the base 23 and the top edge of the support arm 18, which is, for example, six inches. With reference to FIG. 4, the distance "d" of the support channel 20 from the base 23 is approximately four inches, and the channel 20 is approximately four and one-half inches wide. The first outer side 13 forms an angle $\theta_1$ of 80 degrees with the horizontal edge 31 of the base 23. The second side 18 forms an angle $\theta_2$ with the horizontal base 23, which is also 80 degrees. The angle $\theta_3$ of the linear edge of inner side 15 with the horizontal is 75 degrees.

The support pillow is preferably manufactured from a hypoallergenic polyurethane foam material having the following specifications: density 1.70–1.80 lb/cu. ft.; ILD 45–51 lbs. The material provides a basically solid but somewhat elastic structure.

The structure of the preferred embodiment exhibits several advantageous functions. The trough or channel 20 provides the proper elevation for the limb, whether in the hospital or during relatively long periods of home recuperation. The height of lower side 18 permits easy entry of the limb into the channel 20. The height of side 15 provides lateral support for the foot 33 and prevents the foot 33 from rotating outwardly. The angle of 75 degrees for side 15 has been selected as the optimum angle to provide such support so as to best enhance the healing process. Use of the support pillow of the preferred embodiment promotes faster healing and reduces rehabilitation time out of surgery.

It may be further observed that the inward angling of outer sides 13, 21 provides an overall pyramid-like shape to the pillow 11. This shaping lends to the pillow's stability and prevents tipping over.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A support pillow comprising:

a substantially solid foam member having a rectangular base with a width and a length, said foam member being of uniform cross-section throughout its entire length and having a first support arm rising 12 inches above said base, a second support arm rising to a height of six inches above said base, and a leg support channel located therebetween having a generally flat support surface portion located four inches above said base;

said first and second support arms each having outer side surfaces rising from opposite side edges of said rectangular base and angled inwardly so as to stabilize said pillow against tipping over;

said first support arm providing a substantially planar inner surface positioned to lie adjacent the outside of a leg resting in said channel at an obtuse angle of 105 degrees with the flat surface portion of said channel.

2. A support pillow comprising:

a substantially solid foam member having a rectangular base with a width and a length, said foam member being of uniform cross-section throughout its entire length and having a first support arm rising at least 12 inches above said base, a second support arm rising to a height of six inches above said base, and a leg support channel located therebetween having a generally flat support surface portion located four inches above said base;

said first and second support arms each having outer side surfaces rising from opposite side edges of said rectangular base and angled inwardly so as to stabilize said pillow against tipping over;

said first support arm providing a substantially planar inner surface positioned to lie adjacent the outside of a leg resting in said channel at an obtuse angle of 105 degrees with the flat surface portion of said channel.

* * * * *